United States Patent [19]

Brandon et al.

[11] Patent Number: 4,934,869

[45] Date of Patent: Jun. 19, 1990

[54] GRIPPER DEVICE FOR COLUMN SUPPORTED STRUCTURES

[75] Inventors: John W. Brandon; Larry R. Kovar, both of Houston, Tex.

[73] Assignee: Marine Contractor Services, Inc., Houston, Tex.

[21] Appl. No.: 409,603

[22] Filed: Sep. 19, 1989

[51] Int. Cl.[5] ..... E02B 17/00

[52] U.S. Cl. ..... 405/199; 24/463; 166/77; 125/423; 254/105; 405/195; 405/221

[58] Field of Search ..... 405/196, 199, 227, 219, 405/221, 228, 195; 175/423; 166/77, 237; 254/106, 95, 107, 29 R; 24/463; 294/102.1; 279/4, 119.3

[56] References Cited

U.S. PATENT DOCUMENTS

| | | | |
|---|---|---|---|
| 1,234,041 | 7/1917 | Knapp | 175/423 |
| 2,689,139 | 9/1954 | Jones et al. | 175/423 X |
| 2,873,580 | 2/1959 | Suderon | 405/199 |
| 2,909,900 | 10/1959 | Suderon | 405/196 |
| 2,944,403 | 7/1960 | Smith | 405/199 |
| 3,068,027 | 12/1962 | Lewis et al. | 175/423 X |
| 3,437,356 | 4/1969 | Todd et al. | 285/3 |
| 4,354,706 | 10/1982 | Coyle | 175/423 X |
| 4,476,936 | 10/1984 | Boyadjieff et al. | 166/77 |
| 4,740,108 | 4/1988 | Levee et al. | 405/221 |

*Primary Examiner*—Dennis L. Taylor
*Attorney, Agent, or Firm*—Kenneth A. Roddy

[57] ABSTRACT

Gripper devices are installed in the spudwells of a platform or causeway section and manually operated to grip the pile to suspend the platform or causeway section in a level position on the piles. Each gripper device has a cylindrical bowl with a flat mounting flange at the bottom end. The bowl has large central bore extending from the top end and terminating in a smaller bore at the bottom end defining a shoulder therebetween. A series of circumferentially spaced actuator segments having a vertical outer wall and a radial flange at the top end are mounted within the bowl by bolts for vertical movement relative to the bowl. The actuator segments have a downwardly and radially outwardly tapered interior wedging surface with a T-shaped slot extending along the wedging surface. A series of slip segments have a toothed interior surface for gripping the pile and a tapered exterior wedging surface corresponding to the wedging surface of the actuator segments. A headed guide button secured to the slip rides in the T-shaped slot to guide the slips along the wedging surfaces. The piles are lowered through the bowl and set into the seabed and the platform or causeway section is leveled horizontal. As the bolts are tightened, the actuator segments move vertically downwardly relative to the bowl and the wedging surfaces engage to wedge the slips radially inward to firmly engage and grip the exterior surface of the pile.

13 Claims, 2 Drawing Sheets

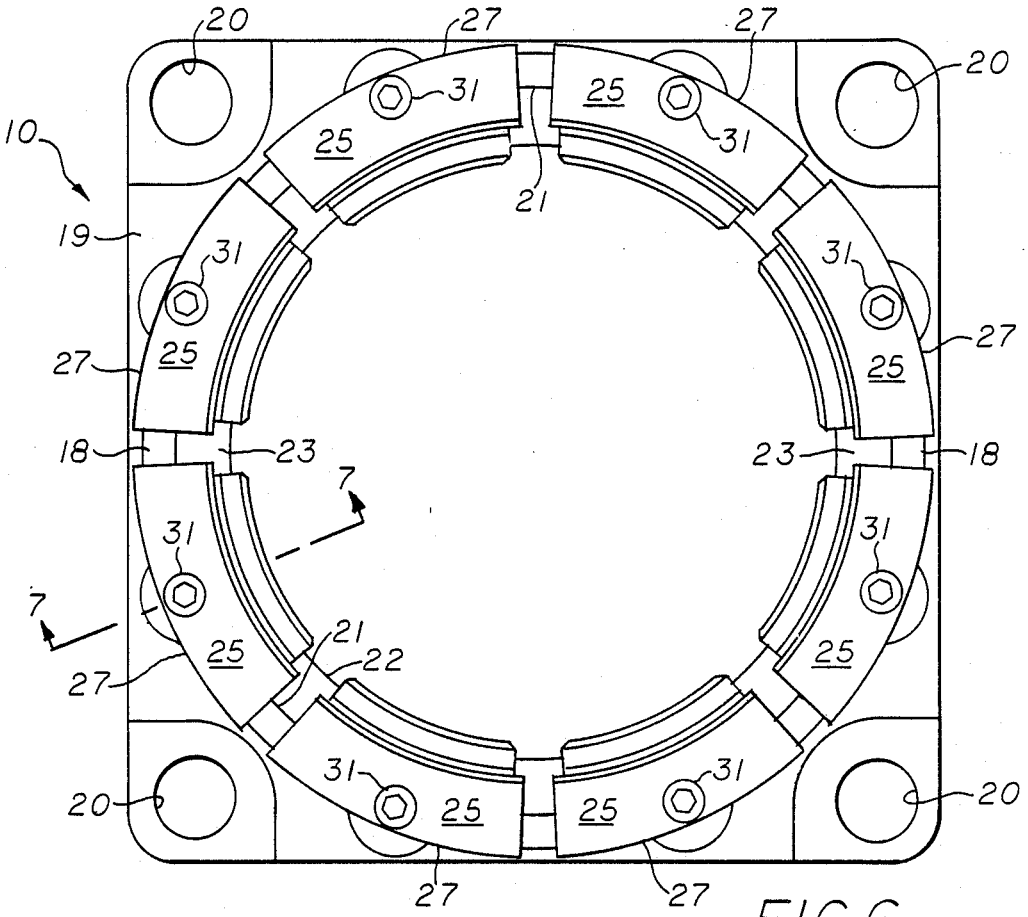
FIG.6
FIG.7
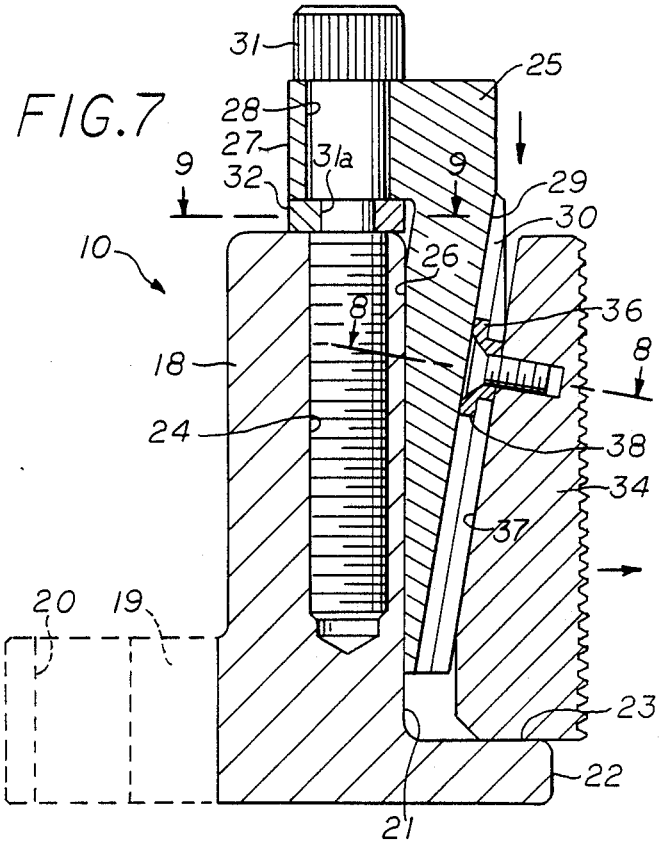
FIG.8
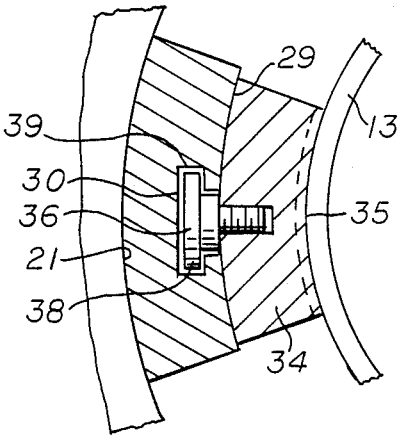
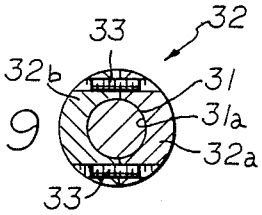
FIG.9

GRIPPER DEVICE FOR COLUMN SUPPORTED STRUCTURES

BACKGROUND OF THE INVENTION

1. Field of the Invention

This invention relates generally to caisson gripping apparatus, and more particularly to a gripper device associated with land or marine columns, poles, posts, caissons, pilings, and the like for connecting a base or platform structure thereto.

2. Brief Description of the Prior Art

Suspended bridges and causeways are often made up of a plurality of prefabricated platform sections which are interlocked end to end to span a waterway. Columns, such as caissons or pilings are installed vertically through the corners of the platform sections after they have been laid into position and the platfrom is secured to the columns. A great deal of time is spent in leveling the platform and securing the platform to the columns in a level position. This process may also be hampered by the movement or slippage of the securing means due to wave action.

Gripping assemblies are known which are used to connect the decks of barges or offshore platforms to columns, caissons, pilings, and the like. There are several patents which disclose gripping assemblies of various construction.

Suderow, U.S. Pat. No. 2,870,639 discloses a gripper and jack assembly having an upper and lower gripper which are selectively controlled to grip the column. Each gripper comprises an annular segmented ring with a plurality of slips movably carried on the inner side. The slips are mounted on each ring segment by flexible straps at their top and bottom ends which permits independent vertical movement of the ring segements and radial or lateral displacement of the slips relative to the ring. The diameter of the ring segments is contracted or expanded by a wedge operated by a fluid cylinder. The slip members have outwardly extending lugs which have a tapered wedge surface received on a corresponding tapered wedge surface in lugs on the ring segements whereby relative vertical movement between the members will cause the slips to grip tighter.

Suderow, U.S. Pat. Nos. 2,873,580 and 2,948,119 disclose a gripper assembly used in conjunction with a jacking mechanism comprising an outer pressure ring which is positioned above an opening in a deck and has circumferentially spaced inclined inner surfaces which engage complimentary inclined surfaces on gripper slips. Circumferentially spaced bolts extend vertically through the pressure ring and holes in the deck. The threaded ends of the bolts are connected to the underside of the deck by a locking nut. Eyelets on the slip and pressure ring receive an inclined rod. C-shaped stop members surround the pressure ring and have a flange which engages a flange on the pressure ring to limit the upward movement of the pressure ring.

Smith, U.S. Pat. No. 2,858,105 discloses a jacking assembly utilizing a gripper assembly having slip wedges spring supported from the deck.

Lucas, U.S. Pat. No. 4,041,711 discloses a hydraulically operated slip assembly which utilizes a T-shaped member between the slips to engage the outer wall of adjacent slips.

Lucas, U.S. Pat. No. 2,858,105 discloses a cable type gripper.

The present invention is distinguished over the prior art in general, and these patents in particular by gripper devices installed in the spudwells of a platform or causeway section and manually operated to grip the pile to suspend the platform or causeway section in a level position on the piles. Each gripper device has a cylindrical bowl with a flat mounting flange at the bottom end. The bowl has large central bore extending from the top end and terminating in a smaller bore at the bottom end defining a shoulder therebetween. A series of circumferentially spaced actuator segments having a vertical outer wall and a radial flange at the top end are mounted within the bowl by bolts for vertical movement relative to the bowl. The actuator segments have a downwardly and radially outwardly tapered interior wedging surface with a T-shaped slot extending along the wedging surface. A series of slip segments have a toothed interior surface for gripping the pile and a tapered exterior wedging surface corresponding to the wedging surface of the actuator segments. A headed guide button secured to the slip rides in the T-shaped slot to guide the slips along the wedging surfaces.

The piles are lowered through the bowl and set into the seabed and the platform or causeway section is leveled horizontal. As the bolts are tightened, the actuator segments move vertically downward relative to the bowl and the wedging surfaces engage to wedge the slips radially inward to firmly engage and grip the exterior surface of the pile.

SUMMARY OF THE INVENTION

It is therefore an object of the present invention to provide a gripper device for column supported structures which does not require expensive modification of the structure to install the device or external power sources to actuate the gripping elements.

It is another object of this invention to provide a gripper device which is installed in the spudwells of a platform or causeway section and manually operable to grip the pile to suspend the platform or causeway section in a level position on the supporting columns.

Another object of this invention is to provide a gripper device for supporting structures suspended above a body of water which will safely maintain the structure in a level position and in the suspended condition the structure causes the gripping elements to firmly engage the surface of the supporting column.

Another object of this invention is to provide a method of erecting a causeway utilizing gripper devices in the spudwells of the causeway sections to secure the causeway sections in a level position on supporting piles.

Another object of this invention is to provide gripper devices which are installed in tee spudwells of causeway sections and which allow the supporting pile to be received through the interior of the gripper devices.

A further object of this invention is to provide a gripper device having components which when damaged are easily and quickly removed and replaced.

A still further object of this invention is to provide a gripper device for column supported structures which is simple in design and construction, economical to manufacture, and rugged and reliable in use.

Other objects of the invention will become apparent from time to time throughout the specification and claims as hereinafter related.

The above noted objects and other objects of the invention are accomplished by gripper devices installed in the spudwells of a platform or causeway section and manually operated to grip the pile to suspend the platform or causeway section in a level position on the piles. Each gripper device has a cylindrical bowl with a flat mounting flange at the bottom end. The bowl has large central bore extending from the top end and terminating in a smaller bore at the bottom end defining a shoulder therebetween. A series of circumferentially spaced actuator segments having a vertical outer wall and a radial flange at the top end are mounted within the bowl by bolts for vertical movement relative to the bowl. The actuator segments have a downwardly and radially outwardly tapered interior wedging surface with a T-shaped slot extending along the wedging surface. A series of slip segments have a toothed interior surface for gripping the pile and a tapered exterior wedging surface corresponding to the wedging surface of the actuator segments. A headed guide button secured to the slip rides in the T-shaped slot to guide the slips along the wedging surfaces. The piles are lowered through the bowl and set into the seabed and the platform or causeway section is leveled horizontal. As the bolts are tightened, the actuator segments move vertically downward relative to the bowl and the wedging surfaces engage to wedge the slips radially inward to firmly engage and grip the exterior surface of the pile.

BRIEF DESCRIPTION OF THE DRAWINGS

FIG. 6 is a top plan view of the gripper device in accordance with the, present invention.

FIG. 7 is a cross section through the gripper device taken along line 7—7 of FIG. 6.

FIG. 8 is a cross section taken along line 8—8 of FIG. 7 showing the T-shaped slot connection between the actuator segments and slip members of the gripper device.

FIG. 9 is a cross section taken along line 9—9 of FIG. 7 showing the split collar which retains the bolts in the flange portions of the actuator segments of the gripper device.

DESCRIPTION OF THE PREFERRED EMBODIMENT

Figure 1:
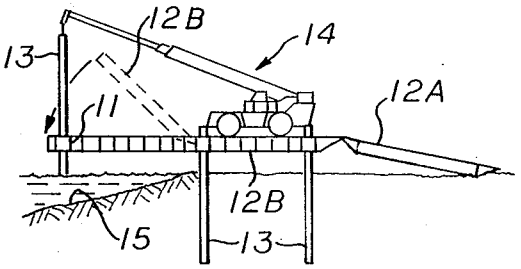
FIGS. 1, 2, and 3 are schematic side elevations illustrating the construction of a causeway utilizing gripper devices in accordance with the present invention.
Figure 2:
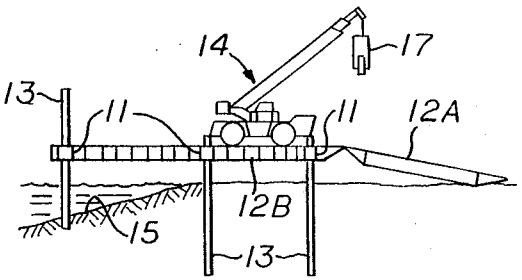
Figure 3:
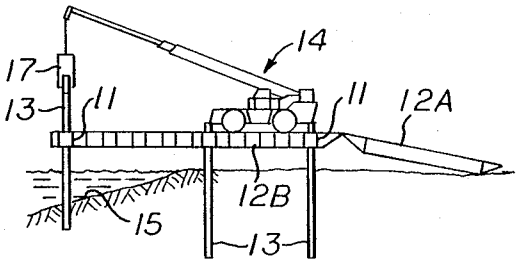
Figure 4:
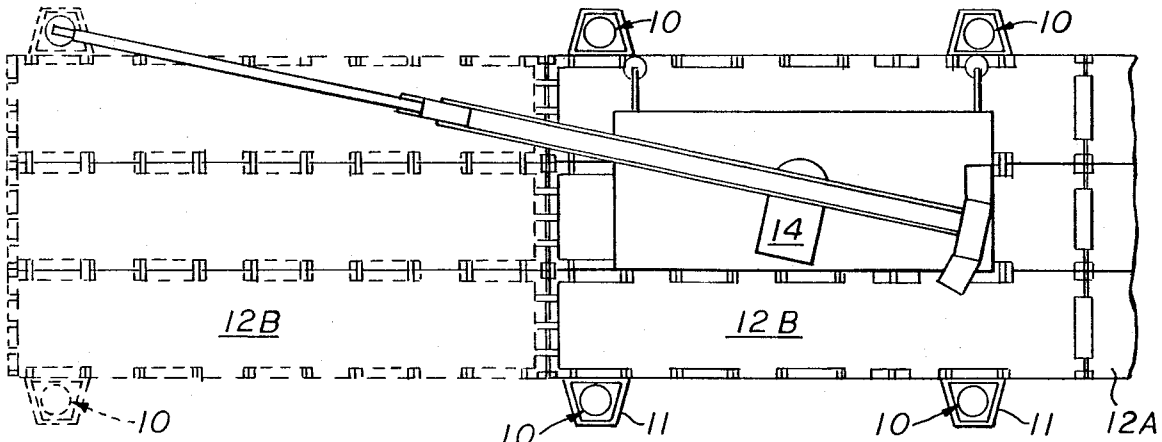
FIG. 4 is a top plan view of a causeway section showing the location of the gripper devices.
Figure 5:
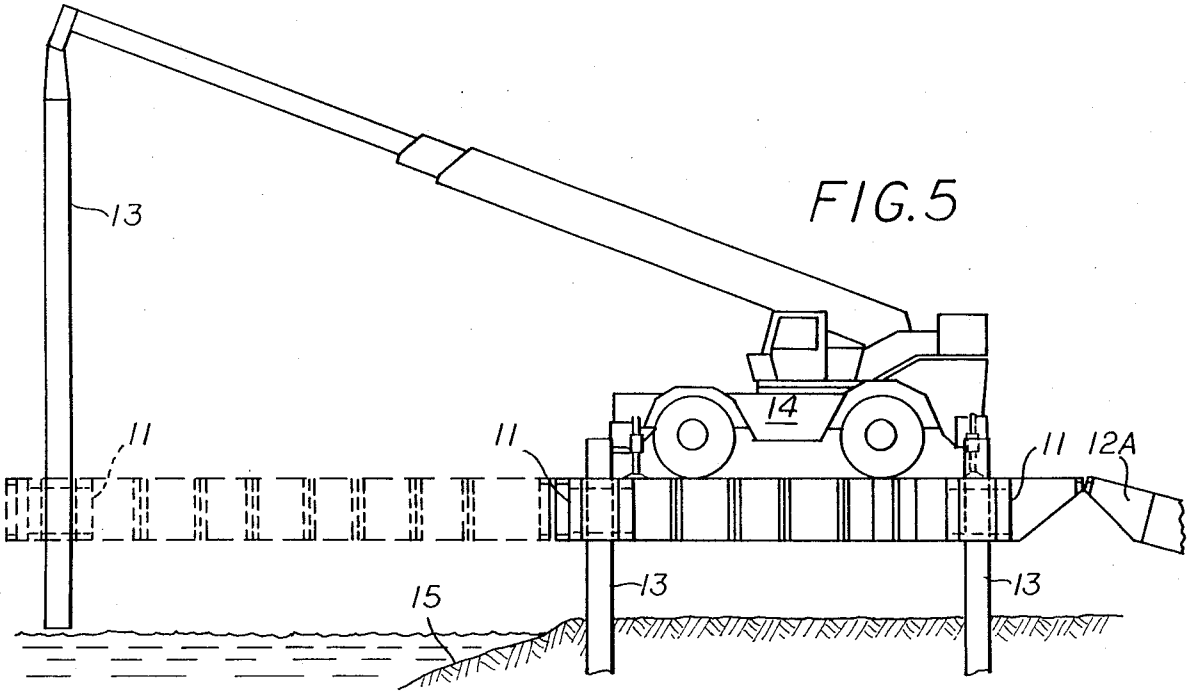
FIG. 5 is a side elevation of a causeway section showing a piling being driven through a spudwell of the causeway section.

Referring to the drawings by numerals of reference, there is shown schematically in FIGS. 1, 2, and 3, a method of constructing a causeway utilizing gripper devices in accordance with the present invention. As best seen in FIGS. 4 and 5, the gripper devices 10 are mounted in the exterior spudwells 11 adjacent the corners of a rectangular causeway platform or section.

Starting from land, a first rectangular causeway platform or section 12A is laid with one end on land and the other end extending out over the water and piles 13 are lowered by a crane 14 through the exterior spudwells 11 and gripper devices 10 mounted therein and released to stab the pile 13 into the seabed 15. The crane 14 is equipped with a pile hammer 17 and the piles 13 are driven into the seabed in a conventional manner. The first causeway section 12A is held in a slightly inclined position by the crane while the gripper devices 10 are manually actuated to secure the causeway section to the piles, as described in detail hereinafter.

The crane 14 is then driven out on the first section 12A. A second causeway section 12B is lifted by the crane 14 and positioned to be pivotally joined at one end to the outer end of the first section 12A and then pivotally lowered into position by the crane.

The causeway sections 12B extending out over the water may be provided with pontoons (not shown) for floatation. Piles 13 are lowered by the crane 14 through the exterior spudwells 11 and gripper devices 10 mounted therein and released to stab the pile 13 into the seabed 15. The crane 14 is equipped with a pile hammer 17 and the piles 13 are driven into the seabed 15. The second causeway section 12B is held in a level position by the crane 14 while the gripper devices 10 are manually actuated to secure the causeway section to the piles. The crane 14 is then driven out onto the second causeway section 12B, and the process is repeated until the joined causeway sections reach the other side of the waterway or the desired length.

Referring now to FIGS. 6, 7, and 8, the gripper device 10 comprises an annular cylindrical bowl member 18 having a generally square flat mounting plate or flange 19 at its bottom end extending laterally outward therefrom and having mounting holes 20 therethrough in the corners. The cylindrical bowl member 18 has a large central bore or vertical inner wall 21 extending from its top end and terminating in a concentric smaller bore 22 at its bottom end defining a flat shoulder 23 therebetween. A series of circumferentially spaced threaded holes 24 extend vertically from the top end of the bowl 18 into the bowl side wall.

A series of actuator segments 25 have a vertical exterior diameter or outer wall 26, a radial flange 27 at its top end with holes 28 therethrough, and a downwardly and radially outwardly tapered interior diameter defining an inclined wedging surface 29. A T-shaped slot 30 extends centrally along the inclined wedging surface 29. The actuator segments 25 are slidably received with their outer wall 26 on the vertical inner wall 21 of the cylindrical bowl 18 and are maintained in a circumferential spaced relation by bolts 31 installed through the holes 28 in the radial flanges 27 and threadedly engaged in the threaded holes 24. Thus the actuator segments 25 are vertically movable relative to the bowl 18 to act as a wedge.

The bolts 31 have a reduced diameter portion 31*a* beneath the bottom of the flange 27 and a split collar 32 is installed on the reduced diameter portion. As shown in FIG. 9, the split collar 32 is in two halves which are secured together around the reduced diameter portion 31*a* by means of small set screws 33. Thus, the split shaft collars 32 rotatably secure the bolts in the flange portions 27 of the actuator segments 25. In this manner, the actuator segments 25 move vertically relative to the bowl 18 upon rotation of bolts 31.

A series of slip segments 34 have a serrated or toothed interior diameter 35 for gripping the exterior surface of the pile 13 and a tapered exterior diameter or wedging surface 37 corresponding to the wedging surface 29 of the actuator segments 25. A headed guide button 36 is secured to the exterior wall or wedging surface 37 of each slip segment 34 and its enlarged head portion 38 is slidably received within the wider portion 39 of the T-shaped slot 30 to guide the slip segment 34 along the wedging surface 29 during relative vertical movement between the actuator segment 25 and the slip segment 34.

OPERATION

Several gripper devices 10 are mounted within the spudwells 11 at the leg positions on a causeway section and the bolts 31 and actuator segments 25 are in the raised position relative t the bowl 18 and the slip segments 34 are radially retracted and rest on the shoulder 23. The pile 13 is lowered through the spudwell 11 and bowl and driven into the seabed, and the causeway section is leveled horizontal, as described above.

As the bolts 31 are tightened, the actuator segments 25 move vertically downward and since the slip segments 34 are bottomed out on the flat shoulder 23 of the bowl 18, the wedging surfaces 29 of the actuator segments ride down on the wedging surfaces 37 of the slip segments 34 and the wedging action forces the slip segments 34 radially inward relative to the bowl to firmly engage and grip the exterior surface of the pile 13.

This procedure is repeated at each leg while the causeway section is maintained level. Thus the causeway section is connected to the supporting piles in a substantially level position. In the suspended condition, the weight of the causeway section will tend to cause the slip segments 34 to ride up on the wedging surface 29 of the actuator segments 25 thus causing the slips to wedge more firmly into engagement on the surface of the pile.

While this invention has been described fully and completely with special emphasis upon a preferred embodiment, it should be understood that within the scope of the appended claims the invention may be practiced otherwise than as specifically described herein.

We claim:

1. A manually operated gripper device for attachment to platforms having a pile receiving opening therethrough for securing the platform to a supporting pile, the gripper device comprising;

an annular cylindrical bowl member having mounting means thereon for securing the bowl member to the platform in a position surrounding the pile receiving opening, said bowl member having a first central vertical bore extending from its top end and terminating in a concentric smaller bore at its bottom end defining a flat shoulder therebetween which surrounds the pile receiving opening and the diameter of the smaller bore being of sufficient diameter to slidably receive the pile on which the platform will be supported, a series of actuator segments each movably mounted in spaced relation and having a downwardly and radially outwardly tapered interior diameter defining an inclined wedging surface, a series of bolt members rotatably secured to said actuator segments and threadedly engaged with said bowl member to maintain said actuator segments in circumferentially spaced relation and upon rotation thereof to move said actuator segments vertically relative to said bowl member, a series of slip segments each having a serrated interior diameter adapted to frictionally engage and grip the exterior surface of the pile and a downwardly and radially outward tapered exterior diameter defining a wedging surface corresponding to the wedging surface of said actuator segments, and slip guide means extending between said slip segment and said actuator segment wedging surfaces to maintain said wedging surfaces in sliding engagement during relative vertical movement between said actuator segments and said slip segments, whereby when said bolts are rotated in one direction, said actuator segments move vertically downward relative to said bowl member and the wedging surfaces of said actuator segments ride down on the wedging surfaces of said slip segments and the wedging action forces said slip segments radially inward relative to said bowl member to firmly engage and grip the exterior surface of the pile and the weight of the platform will tend to cause said slip segments to ride up on the wedging surfaces of said actuator segments to urge said slip segments more firmly into engagement on the exterior surface of the pile, and when said bolts are rotated in the other direction, said actuator segments move vertically upward releasing the wedging forces and allowing the wedging surfaces of said slip segments to ride down on the wedging surfaces of said actuator segments thereby retracting said slip segments radially outward relative to said bowl member to release their grip on the exterior surface of the pile.

2. A manually operated gripper device according to claim 1 wherein said bowl member has a series of circumferentially spaced threaded holes extending vertically from the top end of said bowl into the bowl cylindrical side wall, each said actuator segment has a vertical exterior diameter and a radial flange at its top end with holes therethrough, and each said bolt member received through and rotatably secured in the holes in said actuator segment radial flange and threadedly engaged in the threaded holes in said bowl side wall, said actuator segments each slidably received with their vertical exterior diameter on the first central vertical bore of said bowl and maintained in a circumferential spaced relation by said bolts whereby said actuator segments are vertically movable relative to said bowl upon rotation of said bolt members.

3. A manually operated gripper device according to claim 2 wherein said bolts are rotatably secured in the hole in said actuator segment radial flanges by a split collar installed on said bolts beneath the underside of the flange.

4. A manually operated gripper device according to claim 1 wherein said slip guide means comprises a T-shaped slot extending centrally along said actuator segment wedging surfaces, and a headed guide button secured to the wedging surface of each said slip segment and having an enlarged head portion slidably received within the wider portion of said T-shaped slot.

5. A manually operated gripper device according to claim 1 wherein said bowl member mounting means comprises a generally square flat mounting flange at the bottom end of said cylindrical bowl and extending laterally outward therefrom and having mounting holes therethrough in the corners to receive bolts for securing said bowl member to the platform.

6. The combination with a platform having a pile receiving opening therethrough of a manually operated gripper device for securing and supporting the platform on the pile comprising;

a platform having at least one vertical opening therethrough for receiving a supporting pile therethrough, at least one pile for supporting said platform, an annular cylindrical bowl member having mounting means thereon for securing the bowl member to the platform in a position surrounding the pile receiving opening, said bowl member having a first central vertical bore extending from its top end and terminating in a concentric smaller bore at its bottom end defining a flat shoulder therebetween which surrounds the pile receiving opening and the diameter of the smaller bore being of sufficient diameter to slidably receive the pile on which the platform will be supported, a series of actuator segments each movably mounted in said bowl first central vertical bore in circumferentially spaced relation and having a downwardly and radially outwardly tapered interior diameter defining an inclined wedging surface, a series of bolt members rotatably secured to said actuator segments and threadedly engaged with said bowl member to maintain said actuator segments in circumferentially spaced relation and upon rotation thereof to move said actuator segments vertically relative to said bowl member, a series of slip segments each having a serrated interior diameter adapted to frictionally engage and grip the exterior surface of the pile and a downwardly and radially outward tapered exterior diameter defining a wedging surface corresponding to the wedging surface of said actuator segments, and slip guide means extending between said slip segment and said actuator segment wedging surfaces to maintain said wedging surfaces in sliding engagement during relative vertical movement between said actuator segments and said slip segments, whereby when said bolts are rotated in one direction, said actuator segments move vertically downward relative to said bow member and the wedging surfaces of said actuator segments ride down on the wedging surfaces of said slip segments and the wedging action forces said slip segments radially inward relative to said bowl member to firmly engage and grip the exterior surface of the pile and the weight of the platform will tend to cause said slip segments to ride up on the wedging surfaces of said actuator segments to urge said slip segments more firmly into engagement on the exterior surface of the pile, and when said bolts are rotated in the other direction, said actuator segments move vertically upward releasing the wedging forces and allowing the wedging surfaces of said slip segments to ride down on the wedging surfaces of said actuator segments thereby retracting said slip segments radially outward relative to said bowl member to release their grip on the exterior surface of the pile.

7. The combination according to claim 6 wherein said platform comprises a generally rectangular causeway platform, said at least one pile receiving opening comprises a spudwell at each corner of said causeway platform for guiding said pile in vertical movement relative to said platform, and a said annular cylindrical bowl member is removably secured within each said spudwell surrounding the pile receiving opening.

8. The combination according to claim 7 wherein said bowl member mounting means comprises a generally square flat mounting flange at the bottom end of said cylindrical bowl and extending laterally outward therefrom and having mounting holes therethrough in the corners to receive bolts for securing said bowl member within said spudwell.

9. The combination according to claim 6 wherein said bowl member has a series of circumferentially spaced threaded holes extending vertically from the top end of said bowl into the bowl cylindrical side wall, each said actuator segment has a vertical exterior diameter and a radial flange at its top end with holes therethrough, and each said bolt member received through and rotatably secured in the holes in said actuator segment radial flange and threadedly engaged in the threaded holes in said bowl side wall, said actuator segments each slidably received with their vertical exterior diameter on the first central vertical bore of said bowl and maintained in a circumferential spaced relation by said bolts whereby said actuator segments are vertically movable relative to said bowl upon rotation of said bolt members.

10. The combination according to claim 9 wherein said bolts are rotatably secured in the hole in said actuator segment radial flanges by a split collar installed on said bolts beneath the underside of the flange.

11. The combination according to claim 6 wherein said slip guide means comprises a T-shaped slot extending centrally along said actuator segment wedging surfaces, and a headed guide button secured to the wedging surface of each said slip segment and having an enlarged head portion slidably received within the wider portion of said T-shaped slot.

12. A method of constructing a pile supported platform structure comprising the steps of;

providing a plurality of generally rectangular platforms each having a pile receiving opening therethrough at each corner for receiving and guiding a platform supporting pile in vertical movement relative to said platform and an annular cylindrical bowl member surrounding the pile receiving opening for mechanically restraining relative movement between said platform and said supporting pile;

each said bowl member having a series of circumferentially spaced actuator segments movably mounted therein by bolt members rotatably secured thereto and threadedly engaged with said bowl member to move said actuator segments vertically relative to said bowl member upon rotation thereof and a slip segment slidably engaged on each actuator segment, said actuator segments and said slip segments having opposed wedging surfaces operatively engaged to move said slip segments between a radially retracted and expanded position relative to said bowl member upon vertical movement of said actuator segments, and each said slip segment having a serrated interior gripping surface to frictionally engage and grip the exterior surface of the supporting pile in it extended position;

rotating the bolts of the bowl members of a first platform to move said slip segments to their retracted position;

placing one end of the first platform on a ground surface and suspending the opposite end above the ground surface at the desired elevation and inclination relative to the ground surface;

lowering a pile through each said pile receiving opening and bowl member of the first platform and releasing said pile to stab it into the ground;

driving each said pile into the ground surface;

rotating said bolts to move said slip segments to their extended position to firmly engage and grip the exterior surface of the pile while the first platform is suspended at the desired position and thereafter releasing it whereby the first platform is secured and supported on said piles with its weight urging said slip segments more firmly into engagement on the exterior surface of the pile;

rotating the bolts of the bowl members of a second platform to move said slip segments to their retracted position;

pivotally connecting one end of the second platform to said opposite end of said first platform and pivotally lowering the opposite end of the second platform until it is suspended above the ground surface at the desired elevation and inclination relative to the first platform;

lowering a pile through each said pile receiving opening and bowl member of the second platform and releasing said pile to stab it into the ground;

driving each said pile into the ground surface;

rotating said bolts to move said slip segments to their extended position to firmly engage and grip the exterior surface of the pile while the second platform is suspended at the desired position and thereafter releasing it whereby the second platform is secured and supported on said piles with its weight urging said slip segments more firmly into engagement on the exterior surface of the pile;

rotating the bolts of the bowl members of a subsequent platform to move said slip segments to their retracted position;

pivotally connecting one end of the subsequent platform to said opposite end of said second platform and pivotally lowering the opposite end of the subsequent platform until it is suspended above the ground surface at the desired elevation and inclination relative to the second platform;

lowering a pile through each said pile receiving opening and bowl member of the subsequent platform and releasing said pile to stab it into the ground;

driving each said pile into the ground surface;

rotating said bolts to move said slip segments to their extended position to firmly engage and grip the exterior surface of the pile while the subsequent platform is suspended at the desired position and thereafter releasing it whereby the subsequent platform is secured and supported on said piles with its weight urging said slip segments more firmly into engagement on the exterior surface of the pile; and repeating the recited steps for subsequent platforms until the supported platforms attain the desired length.

13. The method of constructing a pile supported platform structure according to claim 12 including the additional steps of;

rotating the bolts of the bowl members of a final platform to move said slip segments to their retracted position;

pivotally connecting one end of the final platform to said opposite end of the last subsequent platform and pivotally lowering the opposite end of the final platform until it is engaged on the ground surface at the desired elevation and inclination relative to the last subsequent platform;

lowering a pile through each said pile receiving opening and bowl member of the final platform and releasing said pile to stab it into the ground;

driving each said pile into the ground surface; and rotating said bolts to move said slip segments to their extended position to firmly engage and grip the exterior surface of the pile while the final platform is suspended at the desired position and thereafter releasing it whereby the final platform is secured and supported on said piles with its weight urging said slip segments more firmly into engagement on the exterior surface of the pile.

* * * * *